United States Patent [19]

Kasboske

[11] Patent Number: 4,644,452

[45] Date of Patent: Feb. 17, 1987

[54] VEHICLE HEADLAMP WITH FOG PENETRATING CAPABILITY

[76] Inventor: George C. Kasboske, 2820 N. Whipple, Chicago, Ill. 60618

[21] Appl. No.: 791,417

[22] Filed: Oct. 25, 1985

[51] Int. Cl.[4] ..... F21M 2/14

[52] U.S. Cl. ..... 362/214; 362/212; 313/112

[58] Field of Search ..... 362/211, 212, 213, 214, 362/293; 313/112, 115, 316

[56] References Cited

U.S. PATENT DOCUMENTS

| | | | |
|---|---|---|---|
| 1,262,394 | 4/1918 | Schickerling | 362/214 |
| 1,273,969 | 7/1930 | Winston | 362/214 |
| 1,649,975 | 11/1927 | Parks | 362/214 |
| 1,923,181 | 8/1933 | Albers | 362/214 |
| 2,391,922 | 1/1946 | Roper | 313/112 |
| 3,723,721 | 4/1973 | Weber | 362/212 |
| 3,754,135 | 8/1973 | Hulbert, Jr. | 362/293 |
| 4,209,825 | 6/1980 | Shackelford | 362/293 |
| 4,586,116 | 4/1986 | Kasboske | 362/293 |

FOREIGN PATENT DOCUMENTS

| | | | |
|---|---|---|---|
| 145549 | 2/1931 | Switzerland | 362/211 |
| 416561 | 6/1933 | United Kingdom | 362/211 |

*Primary Examiner*—E. Rollins Cross

*Attorney, Agent, or Firm*—Wood, Dalton, Phillips, Mason & Rowe

[57] ABSTRACT

According to the invention, a single headlamp is provided to selectively project a first color light, a second color light or a desired blend thereof. The light color is selected by powering first and second filaments that project light through different portions of a bulb. One bulb portion is preferably clear and the other yellow so that the headlamp can be used either as a high intensity light under normal conditions or as a penetrating light in fog, dust, snow, rain and/or smoke.

17 Claims, 5 Drawing Figures

VEHICLE HEADLAMP WITH FOG PENETRATING CAPABILITY

BACKGROUND ART

1. Field of the Invention

This invention relates to headlamps for moving vehicles and, more particularly, to a high intensity lamp capable of selectively projecting multiple light colors.

2. Background of the Invention

Conventional sealed beam headlamps, used on automobiles, other high speed vehicles and off road vehicles, employ a filament to project white light through a clear, light-diffusing element, which is typically glass or plastic. Many competing objectives come into play in headlamp design. A high intensity lamp that clearly illuminates a highway far in front of a moving vehicle subjects oncoming traffic to the glaring brightness of the unconcealed filament under normal driving conditions. In the presence of fog, dust, snow, rain and/or smoke, the light projected from the headlamp tends to reflect back and obstructs the vision of the vehicle operator without illuminating in front of the vehicle sufficiently to make travel at high speed safe. Fog lamps, which project yellow light that has good penetrating capability in fog, dust, snow, rain and/or smoke, normally do not alone have the intensity to satisfactorily illuminate a roadway at high speeds with unobstructed visibility.

It has heretofore been common to provide both sealed beam white light lamps and fog lamps on the same vehicle. This requires mounting at least four headlamps, which is expensive from a manufacturing standpoint. This cost is ultimately passed on to the consumer. Further, the consumer must bear the burden of replacing twice as many headlights when the lights burn out.

As an alternative to providing separate fog and white light headlamps, a combination yellow and white light lamp is described in my application Ser. No. 653,437, entitled "Improved Vehicle Headlamp". While that particular light construction gives adequate illumination under both normal and adverse weather conditions, the vehicle operator may prefer to project only white or yellow light as conditions may dictate.

SUMMARY OF THE INVENTION

The present invention is specifically directed to overcoming the above enumerated problems in a novel and simple manner.

According to the invention, a single headlamp is provided to selectively project a first or second color light or desired combination thereof. Preferably, the light colors are white and yellow, though any other colors or colors additional to the two colors may be provided.

More specifically, one embodiment of the invention comprises a bulb with separate filaments, one of which projects light through a clear portion of the bulb and another which projects light through a colored portion of the bulb. The colored portion is preferably yellow because of the superior penetrating capability of light in the yellow wave length range in fog, smoke, snow, rain and/or dust. A control circuit allows the filaments to selectively be powered to project either white or yellow light or a combination thereof which best suits the particular driving conditions.

Alternatively, separate bulbs can be incorporated into the headlamp, with each transmitting a different color light. The filaments associated with each bulb can be selectively powered by a similar control circuit to that previously discussed and, by incorporating a rheostat, desired combinations of white and yellow light can be chosen in similar fashion to the prior embodiment.

The present invention can be incorporated into a conventional structure that is approved for highway driving. The standard bulb can be enlarged to provide a colored zone and an associated, separate filament without effecting the location of the high and low beam filaments or the performance of the bulb projecting white light.

It should be understood that the inventive lamp has applications other than to illuminate in front of a moving vehicle. For example, the bulb can be incorporated into a hand-held flashlight or any other illuminating structure.

Other objects and advantages of the invention will become apparent upon reviewing the following detailed description, taken in conjunction with the claims and the appended drawings.

DETAILED DESCRIPTION OF THE DRAWINGS

Figure 1:
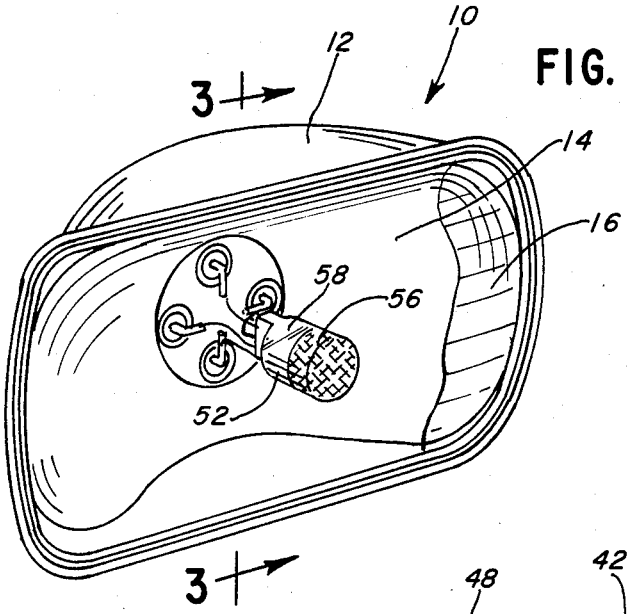
FIG. 1 is a perspective view of a conventional type headlight housing with a bulb according to the present invention incorporated.

A sealed beam headlamp is depicted in FIG. 1 at 10. The conventional portion of the headlamp 10 comprises a molded plastic housing 12 with a forwardly facing parabaloidal reflective surface 14 enclosed by a glass plastic light-diffusing element 16. The surface 14 is made reflective by a thin coating 17 of aluminum or the like applied as a vapor in vacuum. At the rear of the housing 12 are integrally formed bosses 18 (FIG. 2), which serve as support for contacts to establish electrical connection between a power source and bulb, as hereinafter described.

Figure 2:
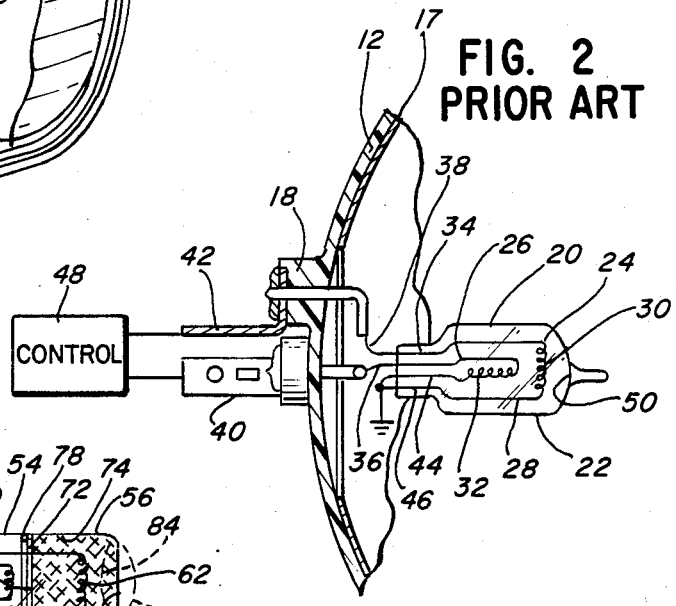
FIG. 2 PRIOR ART
FIG. 2 is a fragmentary, sectional view of a bulb on a conventional headlamp.

A conventional bulb 20 is shown in operative position in the housing 12 in FIG. 2. The bulb has a cylindrical body 22 defining an internal enclosed chamber 24 and contains a high beam filament 26 and a low beam filament 28. Typically the filaments are made from tungsten and project light through coiled portions 30, 32 shown respectively on filaments 26, 28. The rear portion of the bulb 34 is collapsed to seal about the filament leads so that the chamber can be filled with an inert gas to enhance illumination.

The supply leads 36, 38 for the high and low beam filaments project through the bosses 18 and are soldered to blade-type male contacts 40, 42 which are arranged for press fit reception in a conventional electric socket associated with the vehicle to which the headlamp is attached. The ground wires 44, 46 for the high and low beam filaments are in electrical contact with an additional blade connector (not shown). The wires 44, 46 are shown schematically grounded in FIG. 2.

With the conventional bulb in place, the high and low beam filaments are selectively powered by a conventional control switch 48, which causes one or the other of the filaments to project light. The coil with the high beam filament coincides with the focal point for the parabaloidal reflective surface 14. Light rays from the high beam filament project forwardly in substantially parallel, concentrated relationship to maximize the range and intensity of the light. The coil in the low beam filament is situated slightly forwardly of the coil in the high beam filament, and, by reason of its situation forwardingly of the focal point for the headlamp, causes light rays to converge resulting in a greater light dispersion and reduces the effective range of the lamp. To control the direction of light rays tending to project forwardly of the filaments, the forward surface 50 of the bulb is concave, opening rearwardly and silvered or otherwise made reflective so that light rays are rebounded toward the principal reflecting surface 14 on the housing 12 for dispersion thereby.

Since the 1950's it has been common for car manufacturers to provide four headlamps for improved illumination. The outer lamps are the double-filament type as described in the preceeding paragraphs. The inner lamps have a single filament high beam of high wattage to produce a spot-light effect. The low beam of the two outer lamps both are focused toward the right and used when meeting other vehicles head on or when overtaking a vehicle. With no approaching traffic, all four high beam lamps can be safely utilized.

Figure 3:
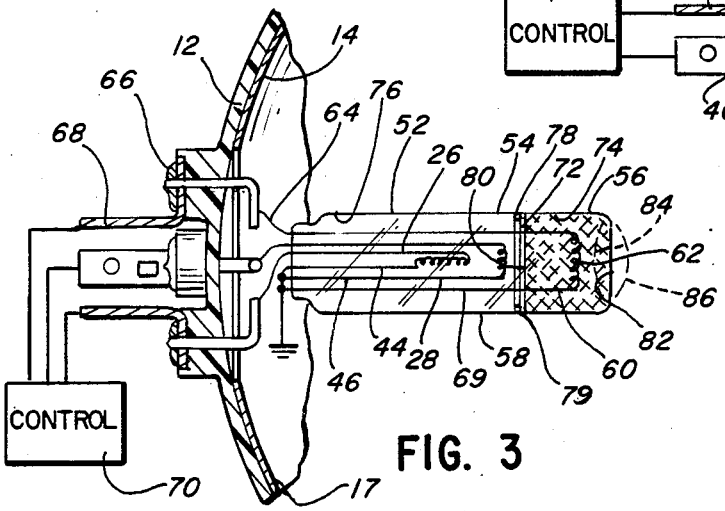
FIG. 3 is a fragmentary, sectional view of the headlamp along line 3—3 of FIG. 1.

One embodiment of the invention is depicted in FIGS. 1 and 3. In those figures, a two color bulb 52 is shown having a cylindrical, light transmitting body 54 whose axis extends forwardly of the reflecting surface 14 of the housing 12. The front portion 56 of the bulb is colored, preferably yellow, while the rear portion 58 of the bulb is clear. The coloring of the front portion 56 of the bulb can be accomplished by molding in the color, dipping a clear bulb, attaching a colored, light transmitting sleeve or by other conventional means known in the art. It should be understood that while white and yellow are disclosed for the bulb colors, any combination of colors is within the scope of the present invention.

The bulb 52 is configured and colored so that the high beam filament 26 and low beam filament 28 are axially within the bounds of the clear rear portion of the bulb. The high and low beam filaments can be identically located as in the prior art bulb 20 shown in FIG. 2. A third filament 60 extends axially with respect to the bulb forwardly of the high and low beam filaments 26, 28 and has a coiled portion 62 axially intersecting the front, colored portion 56. The filament 60 has a lead 64 which is soldered to the housing at 66 and establishes electrical contact with a blade type contact 68. The filament 60 is grounded commonly with the ground leads 44, 46 of the high and low beam filaments through lead 69.

A switching control 70, of a type known to those skilled in the electrical art, allows the operator to selectively power the high beam filament 26, low beam filament 28 and/or additional filament 60. The operator can thereby choose between projecting white light through the high beam or low beam filaments or yellow light through the filament coil 62. By incoporating a rheostat into the control, it is possible to blend white and yellow light depending upon the driving conditions. For example, thick fog may dictate the use of entirely yellow light, whereas slightly dusty conditions may require only a small amount of yellow light intermixed with the white light. It can be seen that by modifying a conventional bulb that is approved for highway operation, one does not affect the operation of the white light portion of the lamp and improves the versatility of the headlamp.

To prevent undesired mixing of light inside the bulb 52 a disk-shaped baffle 72 is mounted within the bulb and defines forward and rear chambers 74, 76 respectively. The baffle is preferably made from tungsten or other suitable material that withstands heat and will not transmit light. An annular gap 78 is maintained about the baffle on the order of appoximately 1/32 of an inch to accommodate expansion when the bulb becomes heated. The baffle can be suspended in the bulb in operative position by a plurality of spacers 79 arranged about the peripheral edge of the disk-shaped baffle 72. The baffle is located axially rearwardly with respect to the bulb from the edge 80 of the yellow colored front portion 56 of the bulb. Preferably the spacing is on the order of $\frac{1}{8}''$. This arrangment tends to shield the yellow colored portion of the bulb more effectively from rays emanating from the high and low beam filaments.

As with conventional bulbs, the forward, free edge 82 of the bulb 52 is coated with a reflecting medium to direct forwardly projecting light back to the reflective surface 14. The forward surface 82 in FIG. 3 is shown flat but may be otherwise concave opening forwardly as shown in phantom at 84 or concave opening rearwardly as shown in phantom at 86 in FIG. 3. The rays otherwise tending to concentrate immediately forward of the filaments are directed back for more effective dispersal. The axial extent of the curvature is approximately $\frac{1}{4}''$ from the apex of the curve to the juncture of the curve and cylindrical bulb body. The coating on the surface 82 may be silver, chrome oxide or other reflective material known by those skilled in the art.

Figure 4:
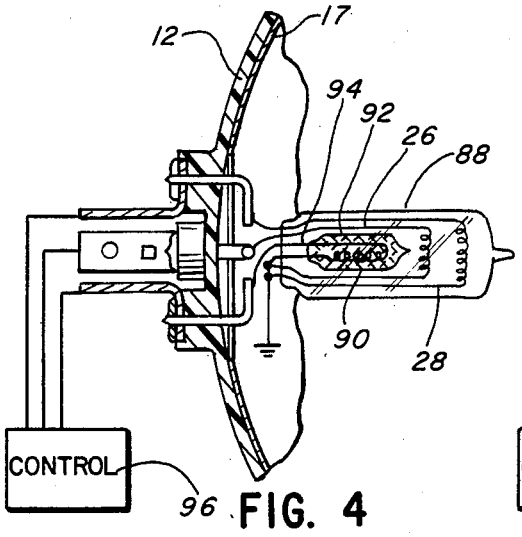
FIG. 4 is a view similar to that in FIG. 3 with an alternative bulb construction according to the present invention.

As an alternative to the embodiment in FIGS. 1 and 3, FIG. 4 discloses a bulb 88 with corresponding high and low beam filaments 26, 28 respectively, which bulb 88 entirely contains a separate bulb 90 that has a light transmitting surface 92 that is preferably yellow colored. The filament 94 associated with the bulb 90 and the filaments 26, 28 are selectively powered by a control 96 in similar fashion to the prior embodiment. The embodiment in FIG. 4 is in all other respects operable in the same manner as the prior embodiment.

Figure 5:
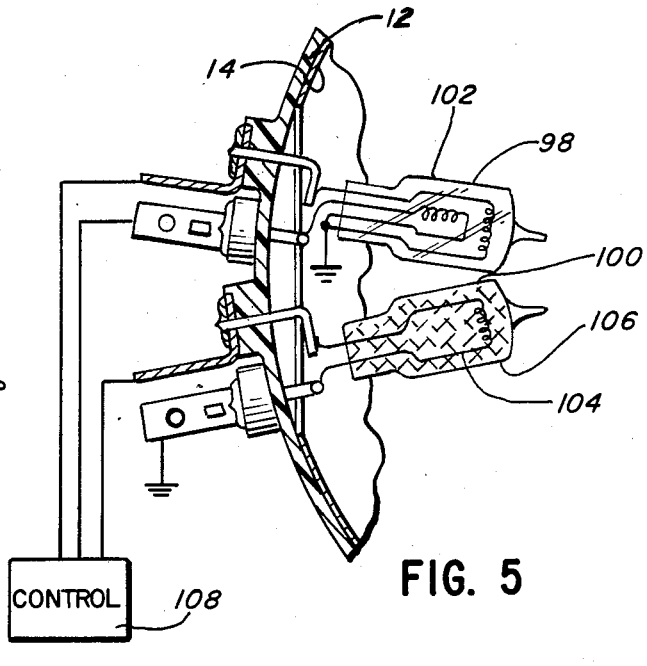
FIG. 5 is a view similar to that in FIGS. 3 and 4 with a modified headlamp structure according to the present invention.

As an alternative to situating separate bulbs in coaxial relationship, one within the other as in FIG. 4, two separate bulbs 98, 100 are disclosed in FIG. 5. The bulb 98 is a conventional high-low beam bulb with a clear light transmitting surface 102. The bulb 100 contains a single filament 104 and has a light transmitting surface 106 that is yellow colored throughout. Powering of the bulbs 98, 100 is accomplished selectively in the same manner as in the prior embodiments through a switch control 108. The arrangement of the bulbs 98, 100 with respect to the housing 12 is only exemplary. The bulbs might be vertically spaced or horizontally spaced from one another. As a still further alternative, the bulbs 98, 100 may be stacked in a forward direction so that the bulb 100 is placed forwardly of the white light bulb 98, though the bulbs remain independently operable. It is desirable to situate the filament coils as close to the focal point for the reflective surface 14 as possible, yet it is desirable to keep as much light as possible from the powered bulb from finding its way through the bulb that is switched off.

While the invention has been described with respect to a vehicle headlamp, the concept may be employed in any type of light i.e. bulbs for home use. Wherever it is desirable to project different colored lights from a common source, the present invention is appropriate.

The foregoing detailed description was made for purposes of demonstrating the structure and operation of the present invention, with no unnecessary limitations to be understood therefrom.

I claim:

1. In a vehicle headlamp with a source of illumination, structure for mounting the illumination source and a reflector for directing light from the illumination source in a desired pattern in front of a forwardly travelling vehicle, the improvement comprising:

said illumination source having first and second filaments respectively with first and second illuminating portions;

a bulb through which light can be transmitted, containing at least a portion of said first and second filaments and having a first portion for causing light transmitted therethrough to have a first color and a second portion for causing light transmitted therethrough to have a second color;

means mounting the first and second filaments so that light from the first and second filaments is directed rearwardly through said bulb toward said reflector;

a baffle member disposed within said bulb and defining first and second bulb chambers within which the first and second illuminating portions respectively reside; and means for selectively controlling illumination of the first and second filaments, whereby with the first filament illuminated the headlamp projects primarily light of said first color and with the second filament illuminated the headlamp projects principally light of said second color, said baffle blocking transmission of light between the first and second chambers to prevent mixing of first color light and second color light from the bulb.

2. The improved vehicle headlamp according to claim 1 wherein the second portion of the bulb is yellow so that with the second filament illuminated the headlamp effectively penetrates fog, dust, snow, rain and/or smoke.

3. The improved vehicle headlamp according to claim 1 wherein said bulb has a substantially cylindrical portion whose axis extends forwardly from the reflecting surface and said chambers are spaced from each other axially with respect to the cylindrical portion.

4. The improved vehicle headlamp according to claim 1 wherein said control means includes a rheostat whereby a desired mixture of first color light and second color light can be selected for the headlamp.

5. The improved vehicle headlamp according to claim 1 wherein said bulb comprises a one-piece construction and said baffle is made from tungsten.

6. The improved vehicle headlamp according to claim 3 wherein said second chamber has a rearwardly facing reflecting surface forwardly of the second filament illumination portion, said reflecting surface directing light from the second filament back towards the reflector.

7. The improved vehicle headlamp according to claim 6 wherein said rearwardly facing reflecting surface is concave opening rearwardly.

8. The improved vehicle headlamp according to claim 6 wherein said rearwardly facing reflecting surface is flat.

9. The improved vehicle headlamp according to claim 6 wherein said rearwardly facing surface is concave opening forwardly.

10. A lighting apparatus with multiple color light projection capability comprising:

a bulb having an internal chamber defined by an internal bulb surface, a light transmitting surface with a first zone for causing light transmitted therethrough to have a first color and a second zone for causing light transmitted therethrough to have a second color;

a first filament which when powered directs light through the first bulb zone to cause light having said first color to project from the bulb;

a second filament which, when powered, directs light through the second bulb zone and to cause light having said second color to project from the bulb;

a baffle; and means mounting the baffle to the internal bulb surface so that at least a portion of the baffle is spaced from the internal bulb surface to accommodate thermal expansion of the baffle and so that the baffle blocks transmission of light from the first filament through said second light zone and transmission of light from the second filament through said first light zone.

11. The lighting apparatus according to claim 10 wherein said first zone is clear and sad second zone is yellow whereby the light source can be used on vehicles selectively as either a fog penetrating light under adverse weather conditions and to project white light under normal conditions.

12. A lighting apparatus with multiple color light projection capability, said lighting apparatus comprising:

a bulb having a substantially cylindrical section through which light can be transmitted, said cylindrical bulb section having a first zone for causing light transmitted therethrough to have a first color and a second zone for causing light transmitted therethrough to have a second color;

a first light source for directing light through the first bulb zone;

a second light source for directing light through the second bulb zone; and shield means for preventing light from the first light source from projecting through said second zone and for preventing light from the second light source from projecting through said first zone, whereby first color light and second color light can be selectively projected by said lighting apparatus.

13. The lighting apparatus according to claim 12 wherein said shield means comprises a baffle and means mount the baffle within the cylindrical section.

14. The lighting apparatus according to claim 13 wherein said cylindrical section has an inside surface and means mount the baffle to the inside surface so that at least a portion of the baffle is spaced from the inside surface to accommodate thermal expansion of the baffle.

15. The improved vehicle headlamp according to claim 1 wherein said first portion is substantially clear and means mount the baffle within said first portion at a location spaced from said second portion.

16. The improved vehicle headlamp according to claim 1 wherein reflector means are provided for reflecting light from said second filament back to the reflector.

17. The lighting apparatus according to claim 10 wherein said means mounting the baffle mount the baffle within said first zone at a location spaced from said second zone.

* * * * *